United States Patent [19]

Junkers

[11] 4,368,655

[45] Jan. 18, 1983

[54] CONTINUOUS RATCHET DRIVE

[76] Inventor: John K. Junkers, 7 Arrowhead La., Saddle River, N.J. 07458

[21] Appl. No.: 205,971

[22] Filed: Nov. 12, 1980

[51] Int. Cl.[3] ..... B25B 29/02

[52] U.S. Cl. ..... 81/57.39

[58] Field of Search ..... 81/57.39; 74/143

[56] References Cited

U.S. PATENT DOCUMENTS

| | | | |
|---|---|---|---|
| 4,027,561 | 6/1977 | Junkers | 81/57.39 |
| 4,079,641 | 3/1978 | Junkers | 81/57.39 |
| 4,086,830 | 5/1978 | Latham | 81/57.39 |

FOREIGN PATENT DOCUMENTS

| | | | |
|---|---|---|---|
| 1294873 | 4/1962 | France | 74/143 |

*Primary Examiner*—James L. Jones, Jr.
*Attorney, Agent, or Firm*—Michael J. Striker

[57] ABSTRACT

A continuous ratchet drive, especially for use in a wrench for tightening or loosening a threaded connector, mainly comprises a support on which a ratchet gear is mounted for rotation about its axis. The ratchet drive includes further a pair of drive pawls engaging with free ends thereof the teeth of the ratchet gear, a cylinder mounted on the support, a piston reciprocable in the cylinder and having a piston rod connected at one end to the piston and a transmission arrangement between the other end of the piston rod and the drive pawls constructed and arranged to move during the forward stroke of the piston one of the drive pawls along an active stroke driving the ratchet gear in a given direction through a given angle while moving the other drive pawl along a return stroke opposite to the active stroke of the one drive pawl over at least one tooth of the ratchet gear, and to move during the rearward stroke of the piston rod the other drive pawl along its active stroke and the one drive pawl along its return stroke so that the ratchet gear is continuously rotated during reciprocation of the piston in the cylinder.

11 Claims, 4 Drawing Figures

CONTINUOUS RATCHET DRIVE

BACKGROUND OF THE INVENTION

Various ratchet drives are known in the art in which a ratchet gear is mounted on a support turnable about its axis and in which a drive arm is provided which may, for instance, be mounted tiltable about a forward and a return stroke about the axis of the ratchet gear and tiltably carrying a drive pawl engaging with a free end thereof the teeth of the ratchet gear to drive the latter through a given angle during the forward stroke of the drive arm, while moving rearwardly during the return stroke of the latter. These known arrangements need a holding pawl for preventing the ratchet gear from moving in the reverse direction while the drive arm moves along its return stroke. The drive arm may be tilted between its forward and its return stroke by fluid operated cylinder and piston means operatively connected thereto.

Such known ratchet drives may be used for many purposes and especially in a wrench for turning a threaded connector. In this case, the ratchet gear may be provided with a coaxial polygonal passage therethrough for engagement with a polygonal head of a threaded connector to be turned.

The evident disadvantage of such known ratchet drives is that the ratchet gear will be turned only during the forward stroke of the drive arm, while remaining stationary during the return stroke of the latter.

SUMMARY OF THE INVENTION

It is an object of the present invention to provide a ratchet drive which avoids the aforementioned disadvantages of known ratchet drives, that is, to provide a continuous ratchet drive, in which the ratchet gear is turned predetermined angles during the forward stroke as well as during the return stroke of the drive arm.

It is a further object of the present invention to avoid the necessity of providing a separate holding pawl to prevent movement of the ratchet gear in the direction opposite to the direction it is moved during the forward stroke of the drive arm.

It is an additional object of the present invention to provide a continuous ratchet drive which is especially suitable for use in a wrench for turning a threaded connector in one direction during the forward stroke as well as during the return stroke of the drive arm.

With these and other objects in view, which will become apparent as the description proceeds, the ratchet drive according to the present invention for a wrench or the like mainly comprises support means, a ratchet gear mounted turnable about its axis on the support means, a pair of drive pawls having respectively free ends engaging the teeth of the ratchet gear, drive means having a single drive element reciprocable along a forward and a rearward stroke, and transmission means between the single drive element and the drive pawls constructed and arranged for moving during the forward stroke of the single drive element one of the drive pawls in a given direction along an active stroke driving the ratchet gear through a given angle and the other of the drive pawls along a return stroke to move in the direction opposite to the given direction over at least one tooth of the ratchet gear and to move during the rearward stroke of the single drive element the other drive pawl along an active stroke and the one drive pawl along the return stroke.

The drive means preferably comprise fluid operated cylinder and piston means, the piston of which constitutes the aforementioned single drive element.

The transmission means preferably comprise drive arm means pivotable about the axis of the ratchet gear and one of the drive pawls being pivotally mounted on the drive arm means and the transmission means includes further lever means carrying the other drive pawl.

The cylinder and piston means comprise a cylinder, a piston reciprocable in the cylinder and a piston rod connected at one end to the piston and projecting with the other end beyond one end of the cylinder.

The other end of the piston rod is pivotally connected at a pivot point to the drive arm means and the lever means carrying the other drive pawl comprise a first lever pivotally connected at one end to the pivot point and tiltably carrying at the other end thereof the other drive pawl and a second lever pivotally connected at one end to the first lever intermediate the ends of the latter and at the other end to the support means.

In another embodiment according to the present invention, the piston rod is pivotally connected at the pivot point to the drive arm means, the lever means carrying the other drive pawl comprise a first lever pivotally connected at one end to the aforementioned pivot point and tiltably carrying at the other end thereof said other drive pawl and a second lever pivotally connected at one end to the first lever intermediate the ends of the latter and at the other end to the cylinder.

In a third embodiment according to the present invention, the one drive pawl is an elongated drive pawl and pivotally mounted intermediate its ends on the drive arm means, the other end of the piston rod being in this case pivotally connected at a pivot point to an end of the elongated one drive pawl which is opposite the free end thereof and the lever means carrying the other drive pawl comprise a first lever pivotally connected at one end to the aforementioned pivot point on the elongated one drive pawl and tiltably carrying at the other end thereof the other drive pawl, whereas the second lever is pivotally connected at one end to the first lever intermediate the ends of the latter and at the other end to the support means.

The novel teachings which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
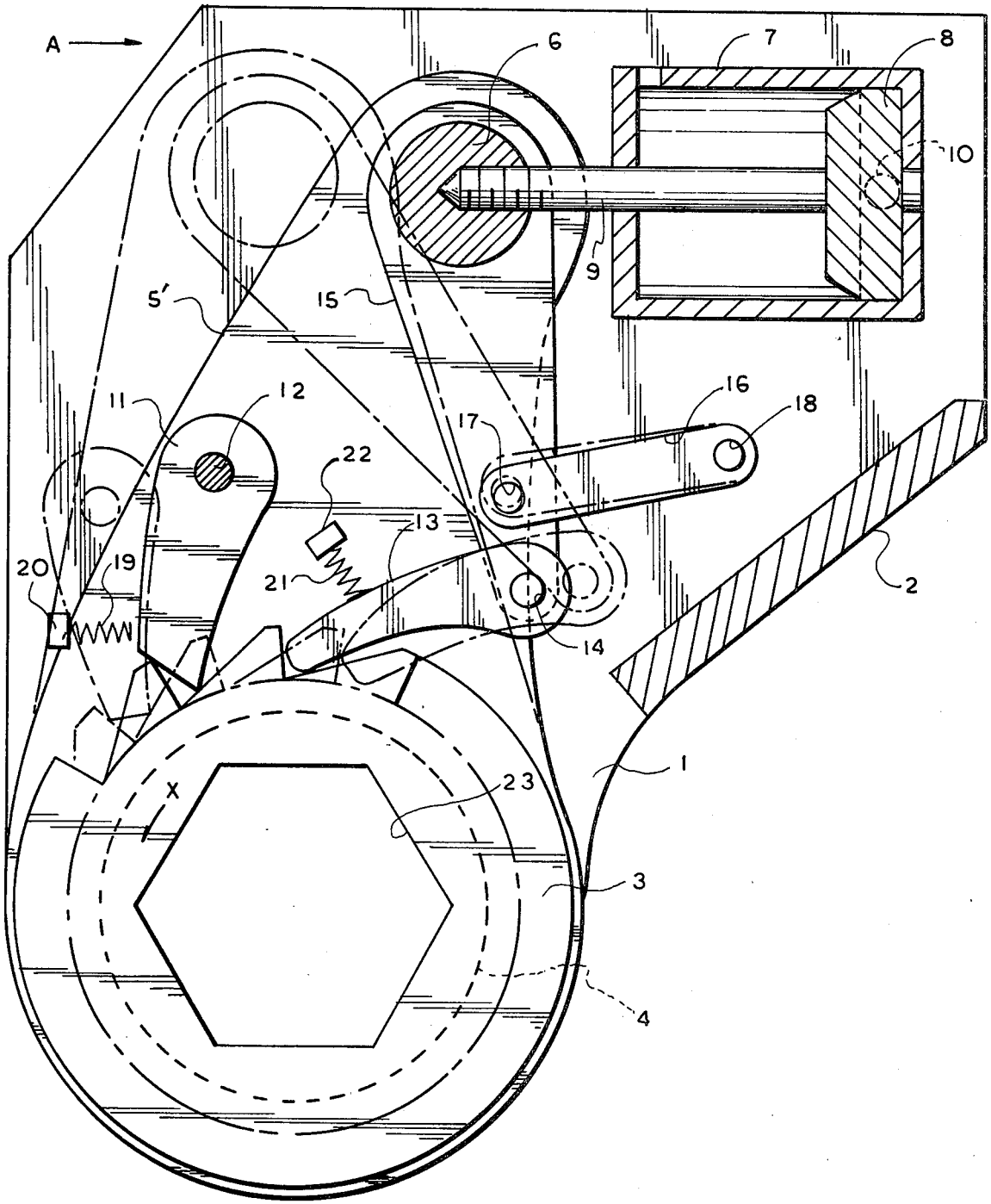
FIG. 1 is a cross-section taken along the line I—I of FIG. 2.
Figure 2:
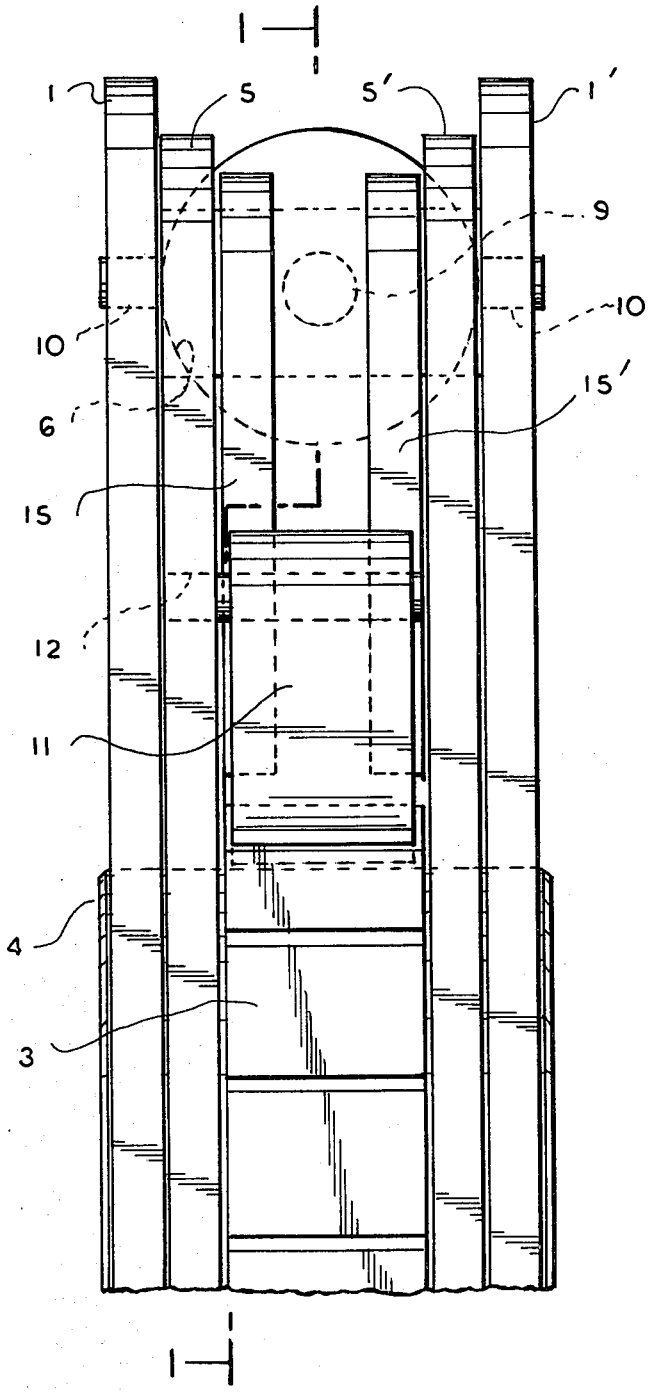
FIG. 2 is a front view viewed in the direction of the arrow A of FIG. 1.

Referring now to the drawings, and more specifically to the embodiment shown in FIGS. 1 and 2, it will be seen that the continuous ratchet drive according to the present invention mainly comprises support means including a pair of transversely spaced parallel support plates 1,1' connected to each other in fixed relationship by a transverse plate 2. A ratchet gear 3 is mounted turnably about its axis between the support plates 1,1'. For this purpose, the ratchet gear is provided with a pair of trunnions 4 projecting to opposite sides of the ratchet gear coaxially therewith and turnably mounted in corresponding bores of the support plates 1 and 1'. A pair of drive arms 5,5' are respectively sandwiched between opposite faces of the support plates 1,1' and the ratchet gear 3 tiltable about the trunnions 4 between a forward and a rearward stroke. The outer ends of the drive arms 5,5' are connected to each other by a pivot pin 6. To drive the drive arms 5,5' along the forward and rearward stroke, cylinder and piston means are provided including a cylinder 7 pivotally connected in the region of the rear end thereof to the support means by pivot pins 10 pivotally mounted in corresponding bores of the support plates 1,1', a piston 8 reciprocable in the cylinder 7 and having a piston rod fixedly connected at opposite ends to the piston 8, respectively to the pivot pin 6.

The ratchet drive further comprises a pair of drive pawls 11 and 13 respectively having free ends engaging the teeth of the ratchet gear. The drive pawl 11 is pivotally carried in the region of the other end thereof on the drive arms 5,5' by means of a pivot pin 12 extending through a bore in the region of the other end of the drive pawl 11 and through corresponding bores in the drive arms 5,5'. The other drive pawl 13 is tiltably mounted by means of a pivot pin 14 extending through a bore in the region of the other end of the drive pawl 13 and corresponding bores in the region of one of the ends of a pair of first levers 15,15', which are mounted transversely spaced from each other in the region of the other ends thereof tiltable about the pivot pin 6. A second lever 16 arranged between the pair of first levers 15,15' is pivotally connected at one end to the latter by means of a pivot pin 17 extending through corresponding bores of the first levers 15,15' and a bore in the lever 16, whereas the other end of the second lever 16 is pivotally connected by a pivot pin 18 extending through a bore at the other end of the lever 16 and corresponding bores in the support plates 1,1'.

The various elements of the ratchet drive are shown in FIG. 1 in full lines at the end of the rear stroke of the piston 8 in the cylinder 7 and in dash-dot lines at the end of the forward stroke of the piston 8 in the cylinder 7. As can be seen from FIG. 1, during the forward stroke of the piston 8, the one drive pawl 11 moving together with the drive arms 5,5' will turn the ratchet gear 3 in clockwise direction while the drive pawl 17 will move backwardly over one tooth of the ratchet gear. During the return stroke of the piston 8 in the cylinder 7, the drive pawl 13 will then move the ratchet gear 3 in the same direction as indicated by the arrow X, whereas the drive pawl 11 will move rearwardly over one tooth of the ratchet gear to be ready to drive the latter again in direction of the arrow X during the next forward stroke of the piston 8. Biasing means are provided for biasing the drive pawls 11 and 13 toward the root circle of the ratchet gear. Such biasing means may include, as shown in FIG. 1, a coil compression spring 19 engaging with opposite ends the drive pawl 11 and an abutment 20 projecting from one of the drive arms 5 or 5', and a coil compression spring 21 abutting with opposite ends against the drive pawl 13 and another abutment 22 projecting from one of the drive arms. Conventional means, not shown in the drawing, are provided for alternatingly feeding pressure fluid, for instance, oil under pressure, into the cylinder to opposite sides of the piston 8 therein, respectively discharge pressure fluid therefrom.

The ratchet drive according to the present invention may be used for many purposes. A preferred use is to tighten or loosen a threaded connector. For this purpose, the trunnions 4 and the ratchet gear 3 are formed with a coaxial polygonal, for instance hexagonal, passage 23 therethrough for engagement with the head of a threaded connector to be turned.

The operation of the above-described ratchet drive will be obvious from the description thereof. The various elements of the ratchet drive are shown in FIG. 1 in full lines at the end of the rearward stroke of the piston 8 and during the forward stroke of the piston the various elements of the ratchet drive are moved to the position shown in dash-dot lines in FIG. 1 and as evident therefrom, during the forward stroke of the piston 8, the drive pawl 11 will drive the ratchet gear through a given angle in the direction of the arrow X, whereas the drive pawl 13 will move backward over a tooth of the ratchet gear to the position shown in dash-dot lines in FIG. 1 due to its connection to the levers 15 and 16. During the following return stroke, the drive pawl 13 will move the ratchet gear 3 through a given angle in the same direction, whereas the drive pawl 11 will move back over a tooth of the ratchet gear. During turning of a threaded connector engaged in the passage 23 a moment will be produced tending to turn the whole ratchet drive arrangement about the axis of the ratchet gear in a direction opposite to the direction indicated by the arrow X. To counteract this moment, the transverse plate 2 may abut against a fixed abutment, for instance, the head of a threaded connector adjacent to one to be engaged in the passage 23. As evident from FIG. 2, the overall width of the ratchet drive according to the present invention is relatively small so that when the ratchet drive is used as a wrench it may be applied at locations where the overall height for applying such a wrench is relatively small.

Figure 3:
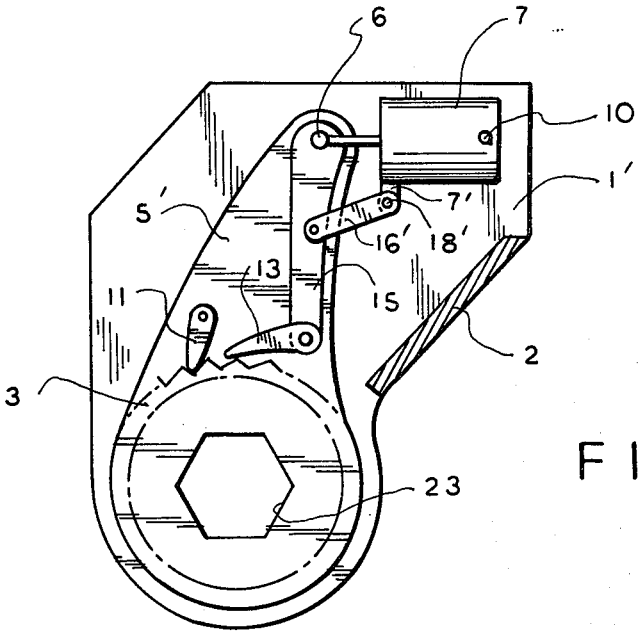
FIG. 3 is a schematic view showing a second embodiment according to the present invention.

FIG. 3 illustrates a second embodiment of the ratchet drive according to the present invention, which differs from the embodiment described above only in that the second lever 16' has a forked right end, as viewed in FIG. 3, which is pivotally attached by a pivot pin 18', not to the support plates 1,1', but to a downwardly extending projection 7' at the left end of the cylinder 7.

Figure 4:
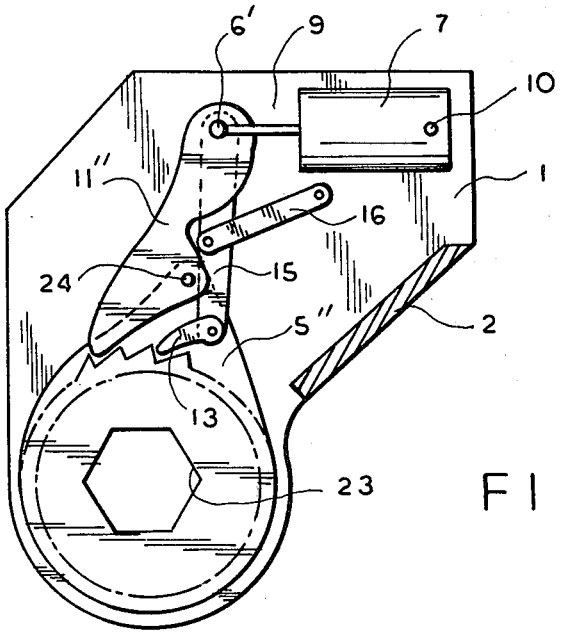
FIG. 4 is a schematic view of a third embodiment according to the present invention.

A third embodiment is schematically illustrated in FIG. 4. This embodiment differs from that shown in FIGS. 1 and 2 in that the drive arms 5'' are considerably shorter than those shown in FIG. 1, whereas the drive pawl 11'' is considerably longer than the drive pawl 11 shown in FIG. 1 and pivoted intermediate its ends by a pivot pin 24 to the region of the upper ends of the drive arms 5''. The piston rod 9 is in this case pivotally connected by a pivot pin 6' to the upper end of the drive pawl 11'. The arrangement and connection of the first and second levers 15 and 16 and that of the drive pawl 13 carried by the lever 15 is the same as described above in connection with FIG. 1. For simplification reasons, the biasing means urging the drive pawls toward the root circle of the ratchet gear 3 are not shown in FIGS. 3 and 4. It will be evident that the operation of the continuous ratchet drives as illustrated in FIGS. 3 and 4 will be substantially the same as described in connection with the embodiment shown in FIGS. 1 and 2.

In summarizing, it is pointed out that the ratchet drive according to the present invention has not only the advantage that the ratchet gear will be continuously turned during reciprocation of the piston 8 in the cylinder 7, but that the stroke of the piston can be held relatively small so that the moment applied to the ratchet gear will be substantially constant, and that a wrench using the ratchet drive according to the present invention can be applied at spaces where the overall height for applying such a wrench is very small.

It will be understood that each of the elements described above, or two or more together, may also find a useful application in other types of continuous ratchet drives differing from the types described above.

While the invention has been illustrated and described as embodied in a continuous ratchet drive for use in a wrench, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A ratchet drive for a wrench or the like comprising support means; a ratchet gear mounted turnably about its axis on said support means; a pair of drive pawls respectively having free ends engaging the teeth of the ratchet gear; drive means having a single drive element reciprocatable along a forward and a rearward stroke; and transmission means between said single drive element and said drive pawls constructed and arranged for moving during the forward stroke of said single drive element one of the drive pawls in a given direction along an active stroke driving said ratchet gears through a given angle and the other of said drive pawls along a return stroke to move in a direction opposite to said given direction over at least one tooth of the ratchet gear, and to move during the rearward stroke of said single drive element said other drive pawl along its active stroke and said one drive pawl along its return stroke, said transmission means comprising drive arm means pivotable about the axis of said ratchet gear, one of said drive pawls being mounted on said drive arm means and said transmission means further including lever means carrying the other drive pawl.

2. A ratchet drive as defined in claim 1, wherein said drive means comprise fluid operated cylinder and piston means, the piston of which constitutes the single drive element.

3. A ratchet drive as defined in claim 2, wherein said cylinder and piston means comprises a cylinder, a piston reciprocable in said cylinder and a piston rod connected at one end to said piston and projecting with the other end beyond said one end of said cylinder.

4. A ratchet drive as defined in claim 3, wherein said other end of said piston rod is pivotally connected at a pivot point to said drive arm means, said lever means carrying said other drive pawl comprising a first lever pivotally connected at one end to said pivot point and tiltably carrying at the other end thereof the other drive pawl and a second lever pivotally connected at one end to said first lever intermediate the ends of the latter and at the other end to said support means.

5. A ratchet drive as defined in claim 3, wherein said other end of said piston rod is pivotally connected at a pivot point to said drive arm means, said lever means carrying said other drive pawl comprising a first lever pivotally connected at one end to said pivot point and tiltably carrying at the other end thereof said other drive pawl and a second lever pivotally connected at one end to said first lever intermediate the ends of the latter and at the other end to said cylinder.

6. A ratchet drive as defined in claim 3, wherein said one drive pawl is elongated and pivotally mounted intermediate its ends on said drive arm means, said other end of said piston rod being pivotally connected at a pivot point to an end of said elongated one drive pawl which is opposite the free end thereof and said lever means carrying said other drive pawl comprising a first lever pivotally connected at one end to said pivot point on said elongated one drive pawl and tiltably carrying at the other end thereof said other drive pawl and a second lever pivotally connected at one end to said first lever intermediate the ends of the latter and at the other end to said support means.

7. A ratchet drive as defined in claim 3, and including a first connection connecting said cylinder to said support means and a second connection connecting said one end of said piston rod to said piston, one of said connections being a fixed connection and the other connection being a pivotal connection.

8. A ratchet drive as defined in claim 7, wherein said first connection comprises pivot means in the region of the other end of said cylinder for connecting the latter to said support means pivotally about an axis parallel to that of said ratchet gear, said one end of said piston rod being fixedly connected to said piston.

9. A ratchet drive as defined in claim 1, wherein said support means comprise a pair of transversely spaced support plates fixedly connected to each other, said ratchet gear, said pair of drive pawls, said drive means and said transmission means being arranged between said pair of support plates.

10. A ratchet drive as defined in claim 9, and including means coaxial with said ratchet gear for engagement with a polygonal head of a threaded connector for turning said head during rotation of said ratchet gear.

11. A ratchet drive as defined in claim 10, wherein said ratchet gear has a pair of trunnions coaxially projecting from opposite sides thereof and being turnably mounted in corresponding bores of said support plates, and wherein said engagement means comprises a coaxial polygonal passage extending through said ratchet gear and said trunnion.

* * * * *